US007609254B2

(12) United States Patent
Bu et al.

(10) Patent No.: US 7,609,254 B2
(45) Date of Patent: Oct. 27, 2009

(54) SIGNAL DRIVING SYSTEM FOR A DISPLAY

(75) Inventors: Lin-Kai Bu, Tainan (TW); Ying-Lieh Chen, Tainan (TW); Tsung-Yu Wu, Tainan (TW); Hsin-Ta Lee, Tainan (TW); Bou Herng Hwe, Tainan (TW); Kun Hsiang Lo, Tainan (TW); Tzong Yau Ku, Tainan (TW)

(73) Assignee: Chi Mei Optomelectronics Corp. (TW)

( * ) Notice: Subject to any disclaimer, the term of this patent is extended or adjusted under 35 U.S.C. 154(b) by 624 days.

(21) Appl. No.: 11/055,861

(22) Filed: Feb. 11, 2005

(65) Prior Publication Data

US 2005/0184978 A1 Aug. 25, 2005

(30) Foreign Application Priority Data

Feb. 19, 2004 (TW) ..... 93104091 A

(51) Int. Cl.
*G09G 5/00* (2006.01)

(52) U.S. Cl. ..... 345/204; 345/98; 345/99; 345/100

(58) Field of Classification Search ..... 345/204–206, 345/55–111
See application file for complete search history.

(56) References Cited

U.S. PATENT DOCUMENTS 6,847,346 B2 * 1/2005 Kumagai et al. ..... 345/98
2004/0135757 A1 * 7/2004 Park et al. ..... 345/98

* cited by examiner

*Primary Examiner*—Henry N Tran
*Assistant Examiner*—Christopher E Leiby
(74) *Attorney, Agent, or Firm*—Trop, Pruner & Hu, P.C.

(57) ABSTRACT

The invention relates to a signal driving system for a display. The signal driving system comprises: a signal controller, a flexible connector and a plurality of driving devices. The signal controller is used to produce a first control signal. The flexible connector is connected to the signal controller, and used to receive the first control signal. One of the driving devices is connected to the flexible connector. The driving devices connect in cascade. Each driving device comprises a data input port, a data output port and a driving signal output port. The data input port receives the first control signal or a second control signal. The data output port outputs the second control signal. According to the first control signal or the second control signal, the driving signal output port transmits a driving signal. The signal driving system of the invention can make the data output port of the driving device transmit the second control signal to the next driving device. Therefore, the signal driving system of the invention can resolve the problem between different control signals of different circuit interfaces. Besides, the signal driving system of the invention has the advantage of processing the first control signal in the signal controller and transmitting the second control signal between the driving devices.

19 Claims, 5 Drawing Sheets

SIGNAL DRIVING SYSTEM FOR A DISPLAY

BACKGROUND OF THE INVENTION

1. Field of the Invention

The present invention relates to a signal driving system, more particularly, a source driver for a display.

2. Description of the Related Art

Referring to FIG. 1, a scan driver 11 and a source driver 12 are utilized to control a liquid crystal display for showing image. For example, the scan driver 11 has 256 gate driving lines (G1, G2 . . . , G256) scanned in sequence to control the pixels of the liquid crystal display. The pixels are controlled by corresponding thin film transistors (TFT). The gate driving lines are connected to the corresponding gates of the corresponding thin film transistors, and control ON/OFF switching of the thin film transistors. The source drivers transmit driving signals to the corresponding thin film transistors, and control the gray scale and the brightness of the pixels so as to show image on the liquid crystal display.

Referring to FIG. 2, the conventional source driver 12 usually comprises a signal controller 121, a plurality of connectors 122, 124, and a plurality of driving devices 123, 125. The signal controller 121 receives signals from a host terminal e.g. computer terminal. The signals are processed by an analog/digital converting process, a proportion enlarged/decreased process, and a control signal is transmitted to the connectors 122, 124 by a timing control. The control signal is transmitted to the driving devices 123, 125 by the connectors 122, 124. The driving devices output driving signals to the corresponding thin film transistors according to the control signal.

The control signal of the conventional signal controller 121 is a Transistor Transistor Logic (TTL) signal having amplitude between 0-3.3 voltage. The Transistor Transistor Logic signal has the problem of easily induced electromagnetic interference (EMI). Therefore, the control signal of the signal controller 121 gradually changes to a Reduced Swing Differential Signal (RSDS) with a voltage between 1.1 and 1.3 volts (1.2±0.1 volts). The amplitude of the Reduced Swing Differential Signal is 0.1 voltage, and the Reduced Swing Differential Signal has no electromagnetic interference problem.

However, in the Chip on Glass (COG) and Wiring on Array (WOA) technique, because of the very small diameter of wires on the substrate and the material of the wires on the substrate, the resistance of the wires are very large to seriously decay the amplitude of the Reduced Swing Differential Signal. Therefore, the Reduced Swing Differential Signal cannot be transmitted on the driving devices 123, 125, and the driving devices 123, 125 cannot produce the corresponding driving signal.

Therefore, it is necessary to provide a signal driving system so as to solve the above problem.

SUMMARY OF THE INVENTION

One object of the present invention is to provide a signal driving system for a display. The signal driving system of the invention comprises: a signal controller, a flexible connector and a plurality of driving devices. The signal controller is used for producing a first control signal. The flexible connector is connected to the signal controller, and is used for receiving the first control signal. One of the driving devices is connected to the flexible connector. The driving devices are connected in series. Each driving device has a data input port, a data output port and a driving signal output port. The data input port is used for receiving the first control signal or a second control signal. The data output port is used for outputting the second control signal. The driving signal output port is used for transmitting a driving signal according to the first control signal or the second control signal.

According to the signal driving system of the invention, no matter whether the data input port of the driving device receives the first control signal or the second control signal, the data output port always transmits the second control signal to the next driving device. Therefore, the signal driving system of the invention can resolve the problem between different control signals of different circuit interfaces Besides, the first control signal is a Reduced Swing Differential Signal, and the second control signal is a Transistor Transistor Logic signal. Therefore, the signal driving system of the invention has the advantage of processing the first control signal in the signal controller and transmitting the second control signal between the driving devices.

DETAILED DESCRIPTION OF THE INVENTION

Figure 1:
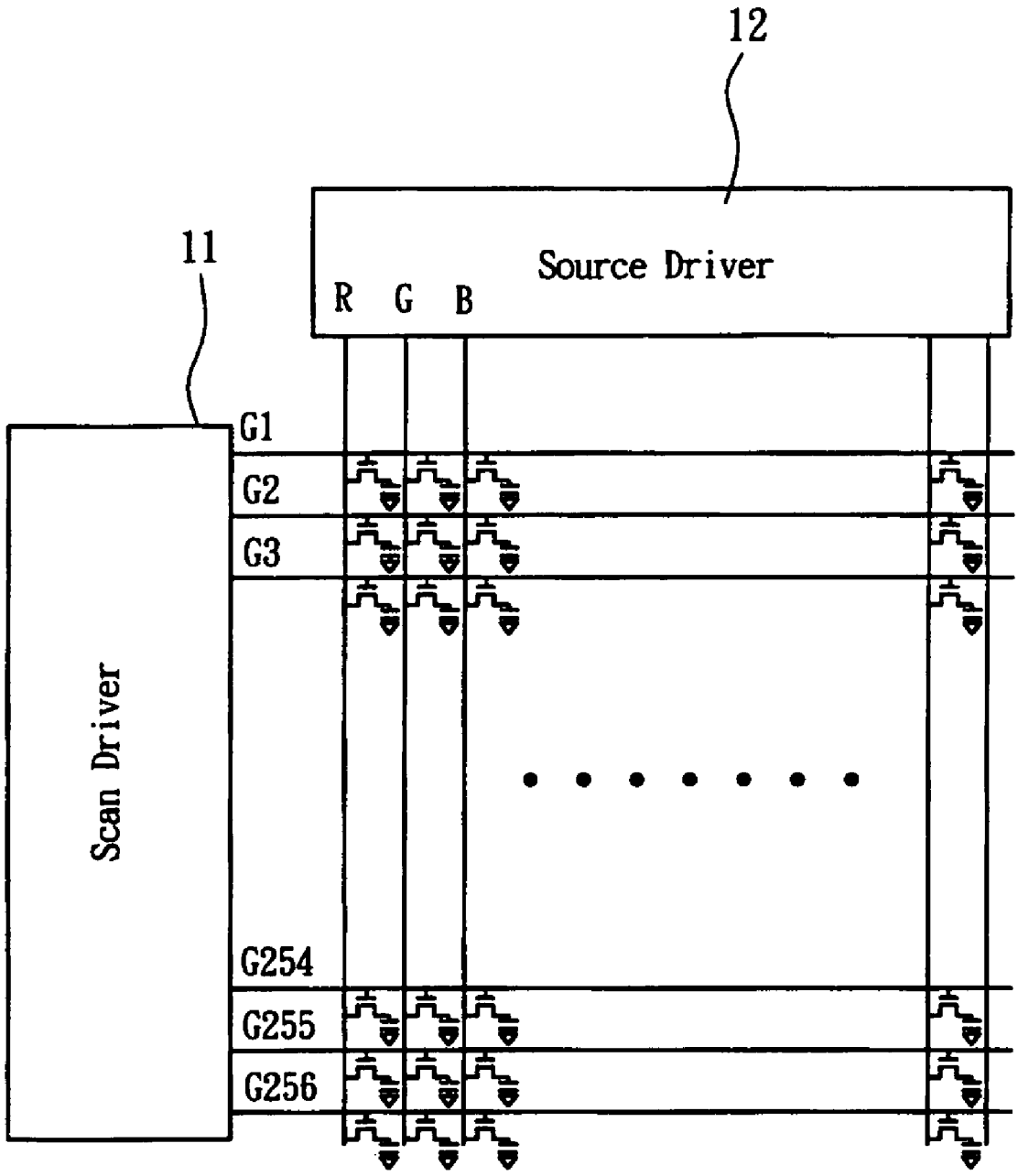
FIG. 1 (Prior Art)
FIG. 1 shows a conventional display using a scan driver and a source driver to control thin film transistor.
Figure 2:
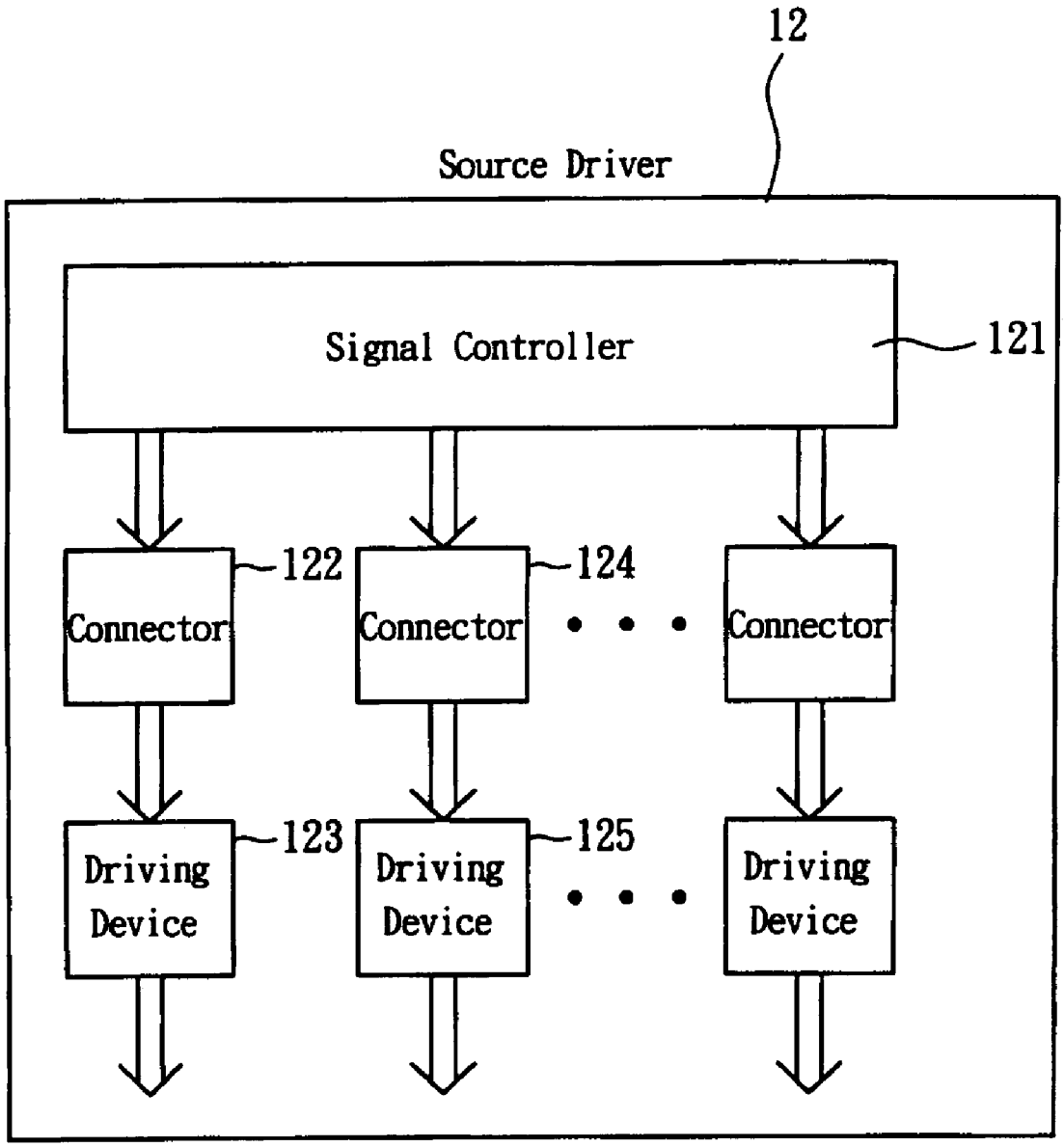
FIG. 2 (Prior Art)
FIG. 2 shows a conventional source driver.
Figure 3:
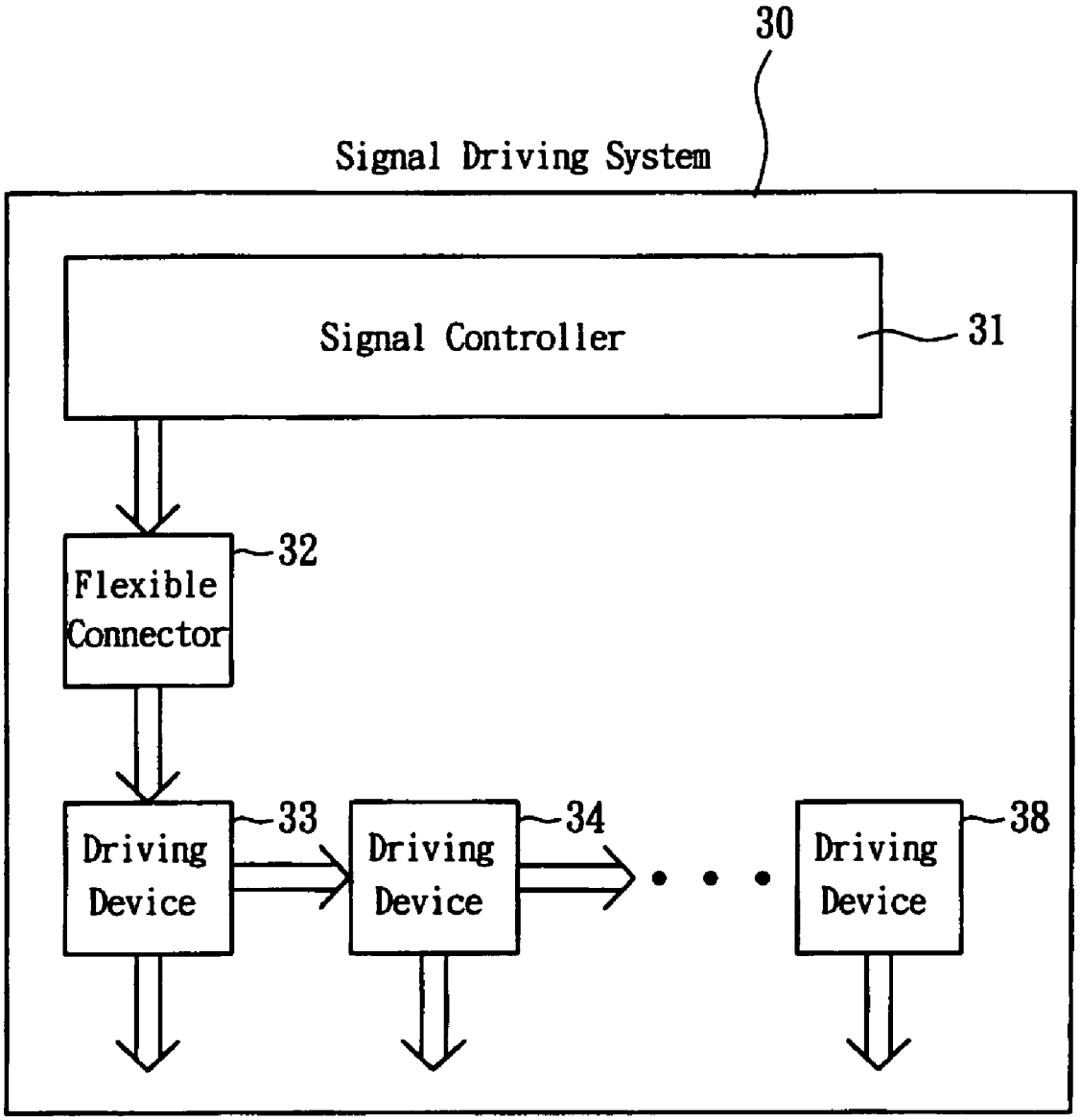
FIG. 3 shows a signal driving system, according to a first embodiment of the invention.

Referring to FIG. 3, according to a first embodiment of the invention, a signal driving system 30 of the invention is used for receiving signals from a host terminal, e.g. computer terminal, and produces driving signals to the corresponding thin film transistor, and controls the gray scale and the brightness of the pixels so as to show image on the liquid crystal display.

The signal driving system 30 of the invention comprises: a signal controller 31, a flexible connector 32 and a plurality of driving devices 33, 34, 38. The signal controller 31 receives analog signals from a computer terminal. The analog signals are processed by an analog/digital converting process, a proportion enlarged/decreased process and timing control. At present, a first control signal is processed in the signal controller 31. The first control signal is a Reduced Swing Differential Signal to prevent the electromagnetic interference (EMI) problem. Therefore, after the signal controller 31 processes the first control signal, the signal controller 31 outputs the first control signal.

The flexible connector 32 connects to the signal controller 31, and receives the first control signal. At present, usually one flexible connector is utilized to receive the first control signal, and transmits the first control signal to a first driving device 33 of the driving devices. The driving devices are connected in series, thus the signals are transmitted in series to the next driving device, for example, the first driving device 33 receives the control signal and transmits the control signal to the second driving device 34.

However, in the Chip on Glass (COG) and Wiring on Array (WOA) technique, because of the very small diameter of wires on the substrate and the material of the wires on the substrate, the resistance of the wires are very large to seriously decay the amplitude of the first control signal (Reduced Swing Differential Signal). Therefore, the first control signal (Reduced Swing Differential Signal) cannot be transmitted between the driving devices 33 and 34. The first control signal received by the first driving device 33 must be converted to a second control signal.

Figure 4:
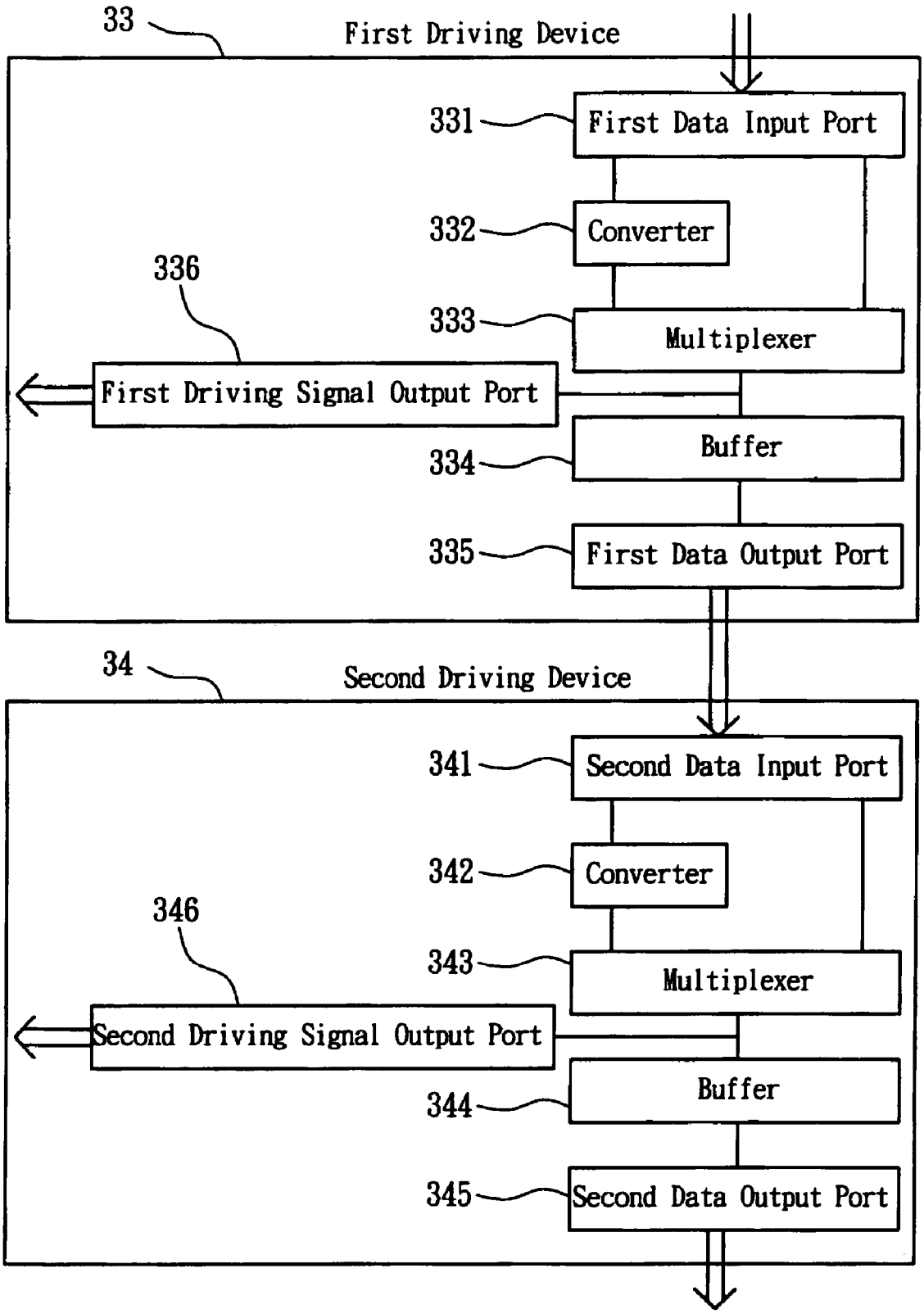
FIG. 4 shows a first driving device and a second driving device of the invention.

Referring FIG. 4, it shows the first driving device and the second driving device of the invention. The first driving device 33 comprises a first data input port 331, a first converting device, a first data output port 335 and a first driving signal output port 336. The first converting device comprises a converter 332, a multiplexer 333 and a buffer 334. Similarly, the second driving device 34 comprises a second data input port 341, a second converting device, a second data output port 345 and a second driving signal output port 346. The second converting device comprises a converter 342, a multiplexer 343 and a buffer 344. The structure of the second driving device 34 is the same as that of the first driving device 33.

The first data input port 331 of the first driving device 33 is used for receiving the first control signal from the flexible connector 32. The first converting device is disposed between the first data input port 331 and the first data output port 335, and is used for converting the first control signal to a second control signal. In detail, the first control signal is converted to the second control signal by the converter 332. The second control signal is a Transistor Transistor Logic signal with amplitude between 0-3.3 voltage. Therefore, the second control signal can be transmitted between the driving devices without seriously decayed signal problem.

The multiplexer 333 has at least two input terminals connected respectively to the first data input port 331 and the converter 332. The first data input port 331 outputs the first control signal, and the converter 332 outputs the second control signal. The multiplexer 333 selects the second control signal, and transmits the second control signal to the buffer 334. The buffer 334 is connected between the multiplexer 333 and the first data input port 335. The buffer 334 transmits the second control signal to the first data output port 335. The first data output port 335 outputs the second control signal to the second data input port 341 of the second driving device 34.

The first driving signal output port 336 is connected to the first converting device. In detail, the first driving signal output port 336 is connected to the multiplexer 333. According to the second control signal, the first driving signal output port 336 transmits a first driving signal to the corresponding thin film transistor. In the embodiment, the first driving signal output port 336 is connected to the multiplexer 333. However, the first driving signal output port 336 may be connected to the output of the data input port 331, that is, the input of the first converting device, and may transmit the first driving signal to the corresponding thin film transistor according to the first control signal. Therefore, the first driving signal output port 336 can transmit the first driving signal according to the first control signal or the second control signal.

The second data input port 341 of the second driving device 34 is used for receiving the second control signal from the first data output port 335 of the first driving device 33. Because the second control signal has been input to the second driving device 34, the converter 342 does not operate. The multiplexer 343 selects the second control signal from the second data input port 341, and transmits the second control signal to the buffer 344. The buffer 344 transmits the second control signal to the second data output port 345. The second data output port 345 outputs the second control signal to the next driving device.

For considering the same elements, the structure of the second driving device 34 is the same as that of the first driving device 33, and the structure of the second converting device is the same as that of the first converting device. However, because the second converting does not operate, the second converting device can be omitted, that is, the second data input port 341 may be connected directly to the second data output port 345.

Given the above, the second control signal can be transmitted to every driving device until the last driving device 38 without seriously decayed signal problem. Besides, according to the second control signal, the driving devices after the second driving device produce and transmit a driving signal to the corresponding transistors.

Referring to FIG. 3, the signal driving system 30 comprises a plurality of second driving devices 34, 38 and the first driving device 33, that are connected in series and in sequence. Therefore, the second control signal can be transmitted to the next driving device in order.

Figure 5:
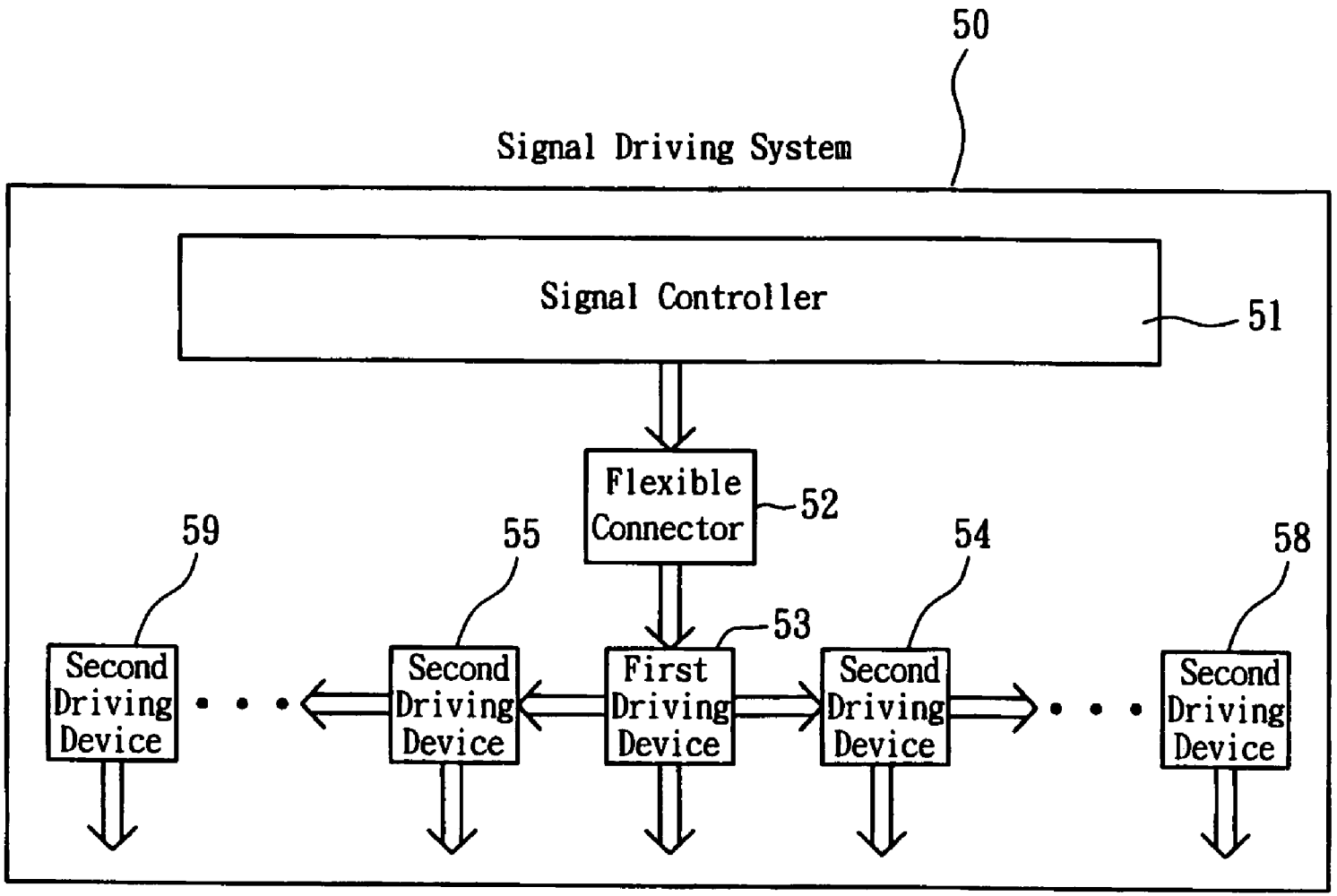
FIG. 5 shows a signal driving system, according to a second embodiment of the invention.

Referring to FIG. 5, according to a second embodiment of the invention, a signal driving system 50 comprises a signal controller 51, a flexible connector 52, a first driving device 53 and a plurality of second driving devices 54, 55, 58, 59. The second driving devices 54, 55, 58, 59 are classified into a first group and a second group. The second driving devices 54, 58 belong to the first group. The second driving devices 55, 59 belong to the second group. The first driving device 53 is disposed between the second driving devices 54, 58 of the first group and the second driving devices 55, 59 of the second group. The first driving device 53 transmits the second control signal to both the second driving devices 54, 58 of the first group and the second driving devices 55, 59 of the second group.

According to the signal driving system of the invention, no matter whether the data input port of the driving device receives the first control signal or the second control signal, the data output port always transmits the second control signal to the next driving device. Therefore, the signal driving system of the invention can resolve the problem between different control signals of different circuit interfaces.

Besides, the first control signal is a Reduced Swing Differential Signal, and can reduce the influence caused by electromagnetic interference and is suitable for processing in the signal controller. The second control signal is a Transistor Transistor Logic signal without seriously decayed signal problem caused by large resistance of the wire. Therefore, the signal driving system of the invention has the advantage of processing the first control signal in the signal controller and transmitting the second control signal between the driving devices.

While an embodiment of the present invention has been illustrated and described, various modifications and improvements can be made by those skilled in the art. The embodiment of the present invention is therefore described in an illustrative, but not restrictive, sense. It is intended that the present invention may not be limited to the particular forms as illustrated, and that all modifications which maintain the spirit and scope of the present invention are within the scope as defined in the appended claims.

What is claimed is:

1. A signal driving system for a display, comprising:

a signal controller, for producing a first control signal;

a flexible connector, for connecting to the signal controller and receiving the first control signal;

a first driving device and at least one second driving device, the first driving device and the second driving device connected in series, the first driving device connected to the flexible connector, the first driving device having a first data input port, a first converting device, a first data output port and a first driving signal output port, the first data input port used for receiving the first control signal, the first converting device disposed between the first data input port and the first data output port, and used for converting the first control signal to a second control signal, the first data output port used for outputting the second control signal to the second driving device, the first driving signal output port connected to the first converting device, and used for transmitting a first driving signal; the second driving device having a second data input port, a second data output port and a second driving signal output port, the second data input port used for receiving the second control signal from the first driving device, and connected to the second data output port so as to transmit the second control signal to the second data output port, the second driving signal output port connected between the second data input port and the second data output port, and used for transmitting a second driving signal according to the second control signal, wherein the first control signal has an amplitude that varies between a first range of voltage levels, and the second control signal has an amplitude that varies between a second range of voltage levels that is larger than the first range of voltage levels.

2. The signal driving system according to claim 1, wherein the signal driving system comprises a plurality of second driving devices, and the first driving device and the second driving devices are connected in series and in sequence.

3. The signal driving system according to claim 1, wherein the signal driving system comprises a plurality of second driving devices, the second driving devices are divided into a first group of second driving devices and a second group of second driving devices, the first driving device disposed between the first group and the second group, the first driving device transmitting the second control signal to the second driving devices of the first group and the second driving devices of the second group.

4. The signal driving system according to claim 2, wherein each of the second driving devices comprises a second converting device connected between the second data input port and the second data output port, the second converting device used for transmitting the second control signal of the second data input port to the second data output port.

5. The signal driving system according to claim 3, wherein each of the second driving devices comprises a second converting device connected between the second data input port and the second data output port, the second converting device used for transmitting the second control signal of the second data input port to the second data output port.

6. The signal driving system according to claim 4, wherein the first converting device comprises a converter, a multiplexer and a buffer, the converter used for converting the first control signal to the second control signal, the multiplexer having at least two input terminals connected respectively to the first data input port and the converter, and used for controlling the second control signal transmitted to the first data output port, the buffer connected between the multiplexer and the first data input port.

7. The signal driving system according to claim 5, wherein the first converting device comprises a converter, a multiplexer and a buffer, the converter used for converting the first control signal to the second control signal, the multiplexer having at least two input terminals connected respectively to the first data input port and the converter, and used for controlling the second control signal transmitted to the first data output port, the buffer connected between the multiplexer and the first data input port.

8. The signal driving system according to claim 6, wherein the second converting device comprises a converter, a multiplexer and a buffer.

9. The signal driving system according to claim 7, wherein the second converting device comprises a converter, a multiplexer and a buffer.

10. The signal driving system according to claim 1, wherein the first control signal is a Reduced Swing Differential Signal.

11. The signal driving system according to claim 1, wherein the second control signal is a Transistor Transistor Logic signal.

12. The signal driving system according to claim 11, wherein the first control signal is a Reduced Swing Differential Signal.

13. The signal driving system according to claim 1, further comprising one of a Chip on Glass (COG) substrate and Wiring on Array (WOA) substrate on which the first and second driving devices are provided.

14. The signal driving system of claim 1, wherein the first control signal is according to a first format, and the second control signal is according to a second, different format.

15. A liquid crystal display (LCD) device, comprising:

pixels and associated thin-film transistors (TFTs);

a first driving device to provide a first driving signal to one of the TFTs;

a second driving device connected in series with the first driving device, the second driving device to provide a second driving signal to another one of the TFTs;

a signal controller to produce a first control signal, wherein the first driving device includes a converter to convert the first control signal into a second control signal, the first driving device to generate the first driving signal according to the first control signal, and the first driving device to provide the second control signal to the second driving device, wherein the second driving device is to generate the second driving signal according to the second control signal, and wherein the first control signal has an amplitude that varies between a first range of the voltage levels, and the second control signal has an amplitude that varies between a second range of voltage levels, wherein the second range is larger than the first range.

16. The LCD device of claim 15 wherein the first control signal is a Reduced Swing Differential Signal, and the second control signal is a Transistor Transistors Logic signal.

17. The LCD device of claim 15, comprising a plurality of second driving devices, the first driving device and the second driving devices connected in series.

18. A display device, comprising:

a plurality of pixels controlled by corresponding thin film transistors;

a signal controller, for producing a first control signal;

a connector, for connecting to the signal controller and receiving the first control signal; and a first driving device and at least one second driving device, the first driving device and the second driving device connected in series, the first driving device connected to the connector, the first driving device having a first data input port, a first converting device a first data output port and a first driving signal output port, the first data input port used for receiving the first control signal having a first signal format, the first convening device disposed between the first data input port and the first data output port, and used for converting the first control signal to a second control signal having a second, different signal format, the first data output port used for outputting the second control signal to the second driving device, the first driving signal output port connected to the first converting device, and used for transmitting a first driving signal to a corresponding thin film transistor; the second driving device having a second data input port, a second data output port and a second driving signal output port, the second data input port used for receiving the second control signal from the first driving device, and connected to the second data output port so as to transmit the second control signal to the second data output port, the second driving signal output port connected between the second data input port and the second data output port, and used for transmitting a second driving signal according to the second control signal to a corresponding thin film transistor, wherein the first control signal has an amplitude that varies between a first range of the voltage levels, and the second control signal has an amplitude that varies between a second range of voltage levels, wherein the second range is larger than the first range.

19. The display device of claim 18, wherein the first control signal is a Reduced Swing Differential Signal, and the second control signal is a Transistor Transistor Logic signal.

* * * * *

UNITED STATES PATENT AND TRADEMARK OFFICE

CERTIFICATE OF CORRECTION

PATENT NO. : 7,609,254 B2
APPLICATION NO. : 11/055861
DATED : October 27, 2009
INVENTOR(S) : Lin-Kai Bu et al.

It is certified that error appears in the above-identified patent and that said Letters Patent is hereby corrected as shown below:

Column 6:
Line 47, "Transistor Transistors" should be -- Transistor Transistor --;
Line 61, "device" should be -- device, --; and
Line 64, "convening" should be -- converting --.

Signed and Sealed this

Fifteenth Day of December, 2009

David J. Kappos

David J. Kappos
*Director of the United States Patent and Trademark Office*